United States Patent [19]

Pathan

[11] Patent Number: 4,459,712

[45] Date of Patent: Jul. 17, 1984

[54] HOSPITAL BED

[76] Inventor: Rajendra K. Pathan, 55 Wheldrake Rd., Sheffield 5, England

[21] Appl. No.: 382,573

[22] Filed: May 27, 1982

[30] Foreign Application Priority Data

Jun. 11, 1981 [GB] United Kingdom ..... 8117975

[51] Int. Cl.[3] ..... A61G 7/08

[52] U.S. Cl. ..... 5/81 C; 5/83; 5/65

[58] Field of Search ..... 5/61, 65, 81 R, 81 B, 5/81 C, 83, 88, 89

[56] References Cited

U.S. PATENT DOCUMENTS 3,401,410 9/1968 Welborn et al. ..... 5/81 R
3,924,281 12/1975 Gibbs ..... 5/81 R
4,109,329 8/1978 Tupper ..... 5/81 B
4,369,533 1/1983 Gisiger ..... 5/81 C

FOREIGN PATENT DOCUMENTS 293819 8/1916 Fed. Rep. of Germany ..... 5/88
1400068 4/1965 France ..... 5/81 R

*Primary Examiner*—Alexander Grosz
*Assistant Examiner*—Michael F. Treittel
*Attorney, Agent, or Firm*—Lockwood, Dewey, Alex & Cummings

[57] ABSTRACT

A hospital bed comprising a frame and a patient support surface constituted by an endless length of flexible material extending around a pair of rollers at the opposite sides of the bed, means being provided for traversing the material around said rollers. The flexible material will preferably be an open mesh material to assist in the healing and prevention of pressure sores.

7 Claims, 4 Drawing Figures

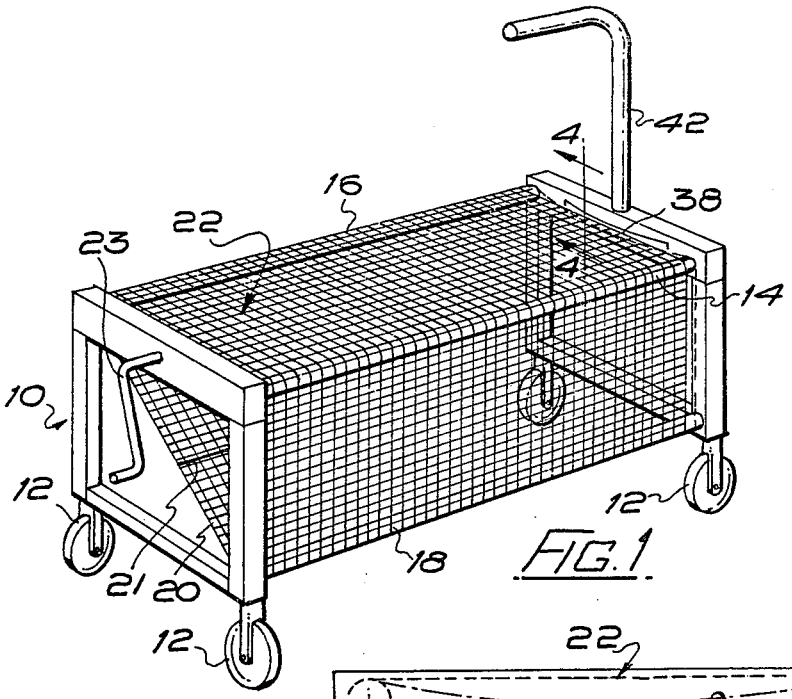
FIG. 1
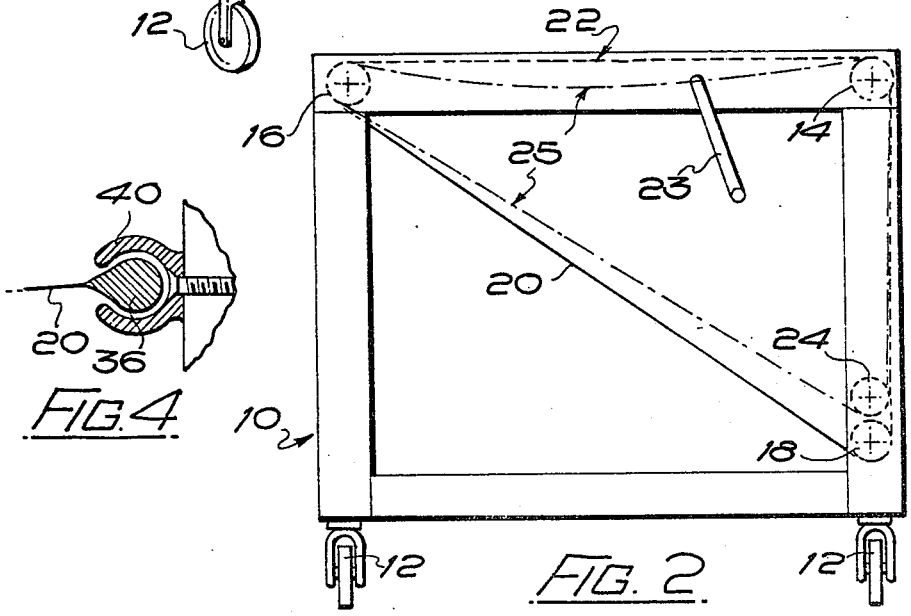
FIG. 2
FIG. 4
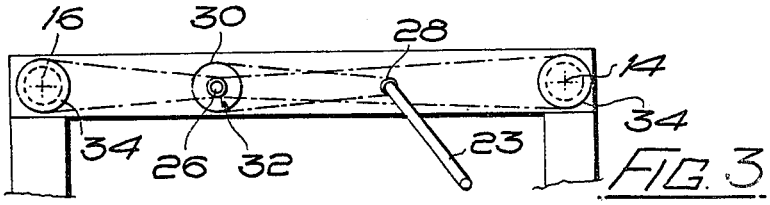
FIG. 3

HOSPITAL BED

The invention relates to hospital beds.

It is a particular problem that, especially in the nursing of very old or unconscious patients the changing of bed linen is a difficult and time comsuming task, so much so that it generally requires two nurses working together to remove soiled sheets and replace them by clean sheets. It is also a problem that some hospital patients, for example paralysed or unconscious patients and those suffering from spinal injuries or multiple burns, and old people who have been confined to bed for some time, frequently suffer from pressure sores and require turning from time to time to heal such sores and prevent further development of such sores. This also may require two or three nurses working together.

The invention aims to at least alleviate the problems referred to.

According to the invention, there is provided a hospital bed including a frame, a pair of rollers extending longitudinally of the frame along the opposite sides of the frame at or in the region of what will be reclining patient height, an endless length of material extending around the rollers to constitute, between said pair of rollers, a patient support surface, and means for traversing said length of material around said rollers whereby the patient support surface is moved laterally to gently turn the patient. The bed will preferably also include at least one further roller at a lower height than said pair of rollers and means for adjusting the position of said at least one further roller around which the endless length of material passes, such adjustment being effective to vary the tension in the endless length of material and thus to adjust the degree of sag in the patient support surface. Restraining means will preferably be provided for preventing the material from "riding" along the rollers, that is to say for preventing the overall width of the material from becoming reduced longitudinally of the rollers. Such restraining means may be constituted by flexible beading extending along the side edges of the material and engaging tracks constituted by lengths of narrow throated extruded sections of material extending along adjacent parts of the bed frame between the pair of rollers at or in the region of reclining patient height. In this case the lengths of material constituting the tracks will preferably be slightly curved to match the natural sag of the opposite ends of the patient support surface in normal use. The bed will preferably also include a further roller at a lower height than said pair of rollers and means for adjusting the position of said further roller around which the endless length of material passes, such adjustment being effective to vary the tension in the endless length of material and thus to adjust the degree of sag in the patient support surface. Said further roller may be located vertically beneath one of the pair of rollers referred to. The material will preferably be an open mesh material and a sliding clasp fastener will preferably be used to form the material into an endless length. The means for traversing the length of material around the rollers may be constituted by drive means for rotating at least one of said rollers, said drive means being either manually operable, in which case it will preferably be a geared down drive, or drivable by means of an electric motor.

In order that the invention may be fully understood and readily carried into effect, the same will now be described, by way of example only, with reference to the accompanying drawings, of which:

FIG. 1 is a perspective view of a hospital bed embodying the invention,

FIG. 2 is an end view thereof,

FIG. 3 is a detail drawing which will presently be referred to, and

FIG. 4 is a sectional view, on the line 4—4 in FIG. 1, drawn to a somewhat larger scale than FIGS. 1, 2 and 3.

Referring now to the drawings, the hospital bed there illustrated includes a frame generally indicated 10 mounted on wheels 12. The bed also includes three rollers rotatably mounted in the frame, that is to say a pair of rollers 14 and 16 extending along the opposite sides of the frame, at or in the region of what will be reclining patient height, and a further roller 18 at a somewhat lower level. An endless length of material 20, which is a strong open mesh material, extends around the three rollers to constitute a patient support surface 22 extending laterally between the rollers 14 and 16. A sliding clasp fastener 21 is used to form the material into an endless length surrounding the three rollers.

Means are provided for traversing the length of material 20 around the rollers whereby the patient, in a reclining position on the bed, can be gently turned as the support surface 22 is moved laterally, said means being manually operable and being shown to be constituted by a cranked handle 23 connected to mechanism housed within a part of the bed frame as shown in FIG. 3 which is a view of that part of the bed frame with a cover plate removed. The cranked handle can be used to drive an intermediate shaft 26 through a 2.1 chain reduction drive, that is to say from a sprocket pinion 28 to a sprocket wheel 30. The intermediate shaft then drives the rollers 14 and 16 through further 2.1 chain reduction drives, these being constituted by respective sprocket pinions 32 disposed side by side on the intermediate shaft 26 and respective sprocket wheels 34 drivably connected to the rollers 14 and 16. The rollers 14 and 16 are rubber covered so that an effective friction drive is maintained between the surfaces of said rollers and the endless length of material 20.

The roller 18 is adjustable in position vertically between the position shown in full lines and a higher position 24, shown in chain-dotted lines in FIG. 2, to vary the tension in the endless length of material 20 and thus to adjust the degree of sag in the patient support surface. The position of the endless length 20 when the roller 18 has been raised to position 24 is indicated by chain-dotted lines 25. The mechanism by which the roller 18 is adjusted in position is not shown in the drawings.

Restraining means are provided for preventing the endless length of material 20 from "riding" along the rollers, that is to say for preventing the overall width of the material from becoming reduced longitudinally of the rollers. Such restraining means are illustrated in FIG. 4 and are constituted by flexible beading 36 extending along the side edges of the length of material 20 and engaging tracks 38 extending along adjacent parts of the bed frame between the pair of rollers 14 and 16 (one only of said tracks being visible in FIG. 1). The tracks 38 are constituted by lengths of narrow throated extruded sections of material 40 through which the bulbous side edges of the length of material 20 can slide. The lengths of material constituting the tracks are very slightly curved to match the natural sag of the opposite ends of the patient support surface in normal use, this amount of sag being somewhat less at the opposite ends of the bed than in the middle.

The arrangement is such that, with the roller 18 adjusted in position so that there is a fair amount of sag in the patient support surface, as shown by chain-dotted lines 25 in FIG. 2, the length of material 20 can be traversed around the rollers as previously described to gently turn the patient. If this is required for the purpose of easing or preventing pressure sores the amount of movement may be quite small but fairly frequent for example just enough in opposite directions to turn the patient through a half turn so that he lies first on one side and then on the other. However, the movement may be effected for the purpose of changing the bed linen in which case the movement may be through a distance to turn the patient several times, that is to say through a first increment of movement sufficient to deliver the soiled sheets to the floor and subsequently through a further increment of movement sufficient to feed clean sheets into the required position beneath the patient, the further increment of movement being in either direction depending on whether the leading edges of the clean sheets have been tucked under one side or the other side of the patient.

Thus is will be seen that there is provided a hospital bed by means of which a patient can be turned, or indeed by means of which the bed linen can be changed, with very little manual effort by the nurses. With the bed described here these tasks can be carried out by a single nurse whereas previously they required two or three nurses working together. In addition, the use of a bed as just described can be expected to reduce the risk of back injuries among nursing staff. When a patient can be turned so very easily by the use of a bed as just described, it can be expected that patients requiring turning will be turned at more frequent intervals. Consequently, it can be expected that the incidence of pressure sores will be greatly reduced because of this fact (in addition to the fact that the use of an open mesh material instead of a conventional mattress overcomes the usual problems of perspiration, pressure and temperature and avoids localised high pressures on the underside of the body which generally give rise to the formation of pressure sores).

Various modifications may be made. For example, the roller 18 need not necessarily be disposed vertically beneath one of the rollers 14 and 16; it could be disposed at some point intermediate the width of the bed. The means for traversing the length of material around the rollers need not necessarily be manually operable. On the contrary, one or more of the rollers 14, 16, 18 may be drivable by means of an electric motor. Furthermore, the tension in the endless length of material extending around the rollers could be adjusted by means for adjusting one of the pair of rollers 14 and 16 in position towards or away from the other, and in this case it may be found that the roller 18 can be omitted. Alternatively, the bed could be provided with four rollers, that is to say with two vertically spaced pairs of rollers, and in this case the tension in the endless length of material could be adjusted by means for adjusting the lowermost pair of rollers towards or away from each other. The endless length of material extending around the rollers need not necessarily be an open mesh material; it could be a stout canvas material. However, an open mesh material is usually preferable because this allows the free flow of air under the patient to achieve maximum skin ventilation to prevent perspiration and accelerate the process of healing pressure sores. In addition, an open mesh material is better able to equalise pressure on the underside of the body, thus allowing the free circulation of blood to the affected area or areas of the patients body so that existing pressure sores tend to heal very quickly and further pressure sores are prevented. Although the material 20 has been said to have been formed into an endless length by means of a sliding clasp fastener it will be understood that it could alternatively be laced or provided with a fastening of so-called "touch and close" material such as that available under the trade mark VELCRO.

The rollers 14 and 16, or at least a drivable one of said rollers, may instead of being rubber covered be provided with a series of projections for engaging the open mesh material 20. Alternatively, edge portions of the endless length of material 20 may be provided with flexible toothed belts engaging similarly toothed portions of the or each driving roller, such toothed belts either being provided in addition to the flexible beading 36 referred to above or being arranged to perform the dual function of engaging the lengths of extruded material 40 for the purpose of preventing the material 20 becoming foreshortened by sagging longitudinally of the bed.

A support for a drip or the like is indicated 42 in FIG. 1, and is constituted by an upstanding pole having an outwarldy extending upper portion which extends over a part of the bed.

What I claim and desire to secure by Letters Patent is:

1. A hospital bed comprising a frame, a pair of rollers extending longitudinally of the frame along the opposite sides of said frame in the region of reclining patient height, an endless length of flexible material extending along the rollers forming a patient support surface therebetween, means for traversing the length of flexible material around said rollers for moving the patient support surface laterally to turn the patient including drive means for rotating at least one of said rollers and, restraining means for preventing said endless length of flexible material from "riding" along said rollers, that is to say for preventing the overall width of said flexible material from becoming reduced longitudinally of said rollers, said restraining means comprising means at the lateral edges of said endless length of flexible material whereby said flexible material lateral edges engage said frame.

2. A hospital bed comprising a frame; a pair of rollers extending longitudinally of the frame along the opposite sides of said frame and in the region of reclining patient height; an endless length of flexible material extending around the rollers to constitute a patient support surface between said rollers, means for traversing the length of flexible material around said rollers for moving the patient support surface laterally to turn the patient and, restraining means for preventing said endless length of flexible material from "riding" along the rollers, that is to say for preventing the overall width of said flexible material from becoming reduced longitudinally of said rollers, said restraining means being constituted by flexible beading extending along the side edges of said endless length of flexible material and engaging track constituted by lengths of narrow throated extruded sections of material extending along adjacent parts of said frame between said pair of rollers in said region of reclining patient height.

3. A hospital bed comprising: a frame; a pair of rollers extending longitudinally of the frame along the opposite sides of the frame and in the region of reclining patient height; an endless length of flexible material extending around the rollers to constitute, between the rollers, a patient support surface; means for traversing the length of flexible material around said rollers for moving the patient support surface laterally to turn the patient; at least one further roller at a lower height than said pair of rollers in the region of reclining patient height; means for adjusting the position of the at least one further roller, around which the endless length of material passes, to vary the tension in said endless length of flexible material and to adjust the degree of sag in said patient support surface; and, restraining means for preventing said endless length of flexible material from "riding" along said rollers, whereby the overall width of the flexible material would be reduced longitudinally of said rollers, the restraining means being constituted by flexible beading extending along the side edges of said engless length of flexible material and engaging tracks constituted by lengths of narrow throated extruded sections of material extending along adjacent parts of the frame between said pair of rollers in the region of reclining patient height.

4. A hospital bed as claimed in claim 3, in which said flexible material forming an endless length of material extending around said rollers is constituted by an open mesh material.

5. A hospital bed as claimed in claim 3, in which said flexible material is formed into an endless length of material extending around said rollers by means of a sliding clasp fastener.

6. A hospital bed as claimed in claim 3, in which said means for traversing the lengths of flexible material around said rollers for moving said patient support surface laterally to turn the patient are constituted by drive means for rotating at least one of said rollers.

7. A hospital bed as claimed in claim 6, said at least one roller to which the drive means are connected being rubber covered so that an effective friction drive is able to be imparted to the endless length of flexible material extending around said rollers.

* * * * *